United States Patent [19]

Sayles

[11] Patent Number: 4,944,816

[45] Date of Patent: Jul. 31, 1990

[54] ULTRA-ULTRAHIGH BURNING RATE COMPOSITE MODIFIED DOUBLE-BASE PROPELLANTS CONTAINING POROUS AMMONIUM PERCHLORATE

[75] Inventor: David C. Sayles, Huntsville, Ala.

[73] Assignee: The United States of America as represented by the Secretary of the Army, Washington, D.C.

[21] Appl. No.: 671,221

[22] Filed: Mar. 26, 1976

[51] Int. Cl.[5] ..... C06B 45/10

[52] U.S. Cl. ..... 149/19.8; 149/7; 149/20; 149/21; 149/76

[58] Field of Search ..... 149/7, 19.4, 19.9, 19.2, 149/20, 22, 76, 19.8, 21

[56] References Cited

U.S. PATENT DOCUMENTS

| | | | |
|---|---|---|---|
| 3,551,224 | 12/1970 | Huskins et al. | 149/19.8 |
| 3,689,331 | 9/1972 | Pierce | 149/19.8 |
| 3,793,097 | 2/1974 | Lawrence | 149/19.4 |
| 3,811,966 | 5/1974 | Hill et al. | 149/19.2 |
| 3,830,672 | 8/1974 | Lista | 149/19.9 |
| 3,883,375 | 5/1975 | Mastrolia et al. | 149/19.9 |
| 4,019,933 | 4/1977 | Cuksee et al. | 149/19.9 |

*Primary Examiner*—Edward A. Miller

*Attorney, Agent, or Firm*—Werten F. W. Bellamy; Jack Voight

[57] ABSTRACT

Ultra-ultrahigh burning rate composite modified double-base propellants are obtained by use of porous ammonium perchlorate as a replacement for the ultra-ultrafine ammonium perchlorate. The porous ammonium perchlorate is used in combination with aluminum powder fuel and aluminum staples, nitroglycerin as an explosive plasticizer, triacetin as a non-explosive plasticizer, stabilizers selected from resorcinol and 2-nitrodiphenylamine and other selected additives for achieving desired processing, mechanical, ballistic, and other properties of the propellant.

2 Claims, No Drawings

ULTRA-ULTRAHIGH BURNING RATE COMPOSITE MODIFIED DOUBLE-BASE PROPELLANTS CONTAINING POROUS AMMONIUM PERCHLORATE

DEDICATORY CLAUSE

The invention described herein may be manufactured, used, and licensed by or for the Government for governmental purposes without the payment to me of any royalties thereon.

BACKGROUND OF THE INVENTION

Various approaches have been pursued to achieve higher and higher burning rates of solid propellants used in the propulsion subsystems of ballistic missile interceptors. Some of these approaches have involved, as time as gone by, the use of progressively finer and finer-ground ammonium perchlorate, combustion catalysts, such as, ferrocenyl and carboranyl burning rate accelerators, and staples of aluminum, zirconium, and graphite. Although the burning rates achieved have been considered outstanding when compared to the prior art, the needs of future advanced terminal interceptors, especially those of the low altitude commit type, will require propellants having burning rates several times faster than those which are currently available.

Characteristics, such as, burning rate controllability, extinguishability, and a high pressure exponent were obtained through use of porous ammonium perchlorate in the specially-compounded solid propellant which was developed for a Controllable Solid Propellant Rocket Program. The results obtained from the use of porous ammonium perchlorate as a portion of the oxidizer in such a propellant resulted in a motor which had a start-stop and restart capability. This contributed significantly to the advancement of the state-of-the art of controllable, solid-propelled propulsion subsystems.

The compatibility of ammonium perchlorate and porous ammonium perchlorate with propellant ingredients has been well established in composite propellant formulations. The high burning rate level which could be achieved by using porous ammonium perchlorate was not assessed since the emphasis has been on the use of more and more finely-ground ammonium perchlorate to provide the major increase in the propellant's burning surface area, and thus achieve the necessary ultrahigh burning rates.

The processing and dispersing problems of high solids loadings propellants have been well recognized. A major problem attendant with the use of the ultrafine ammonium perchlorate, the agglomeration of the ultrafine ammonium perchlorate, has pointed out the need for other approaches which must be pursued in order to raise the burning rates of composite modified double-base propellants required for future advanced terminal interceptors which may use these propellants.

Therefore, an object of this invention is to provide a solid composite modified double-base propellant composition which employs porous ammonium perchlorate oxidizer to achieve an ultra-ultrahigh burning rate for the propellant composition.

Another object of this invention is to provide an ultra-high burning rate composite modified double-base propellant composition which employs about 34 to about 38 weight percent porous ammonium perchlorate to achieve a more than twofold increase in the burning rate without the employment of a special burning rate catalyst.

SUMMARY OF THE INVENTION

A composite modified double-base solid propellant comprised of 34 to 38 weight percent of porous ammonium perchlorate which has a polymeric coating of an N-arylalkeneimine to protect penetration of the pores during propellant processing, 1–3 weight percent aluminum powder, 4–8 weight percent aluminum staples, a binder of 16–20 weight percent nitrocellulose and 28–32 weight percent nitroglycerin, 4–8 weight percent of an inert plasticizer, triacetin, and 1–3 weight percent of stabilizers selected from resorcinol and 2-nitrodiphenylamine yields an ultra-ultrahigh burning rate as compared to an ultrahigh-burning rate propellant wherein the oxidizer is comprised of all ultrafine ammonium perchlorate.

DESCRIPTION OF THE PREFERRED EMBODIMENT

The ultra-ultrahigh burning rate composite modified double-base propellant composition of this invention is listed as Propellant Composition B of Table I compared with Propellant Composition A that contains ultra-ultrafine ammonium perchlorate oxidizer blended with 90-micrometer ammonium perchlorate. The weight percent ranges of the ingredients for Propellant B are also shown.

TABLE I

A COMPARISON OF PROPELLANTS CONTAINING ULTRA-ULTRAFINE AMMONIUM PERCHLORATE AND POROUS AMMONIUM PERCHLORATE

| FORMULATION INGREDIENTS | PROPELLANT COMPOSITION A Weight Percent | B Weight Percent | Weight Percent (RANGE) |
|---|---|---|---|
| Nitrocellulose (12.6% N) | 18.0 | 18.0 | 16–20 |
| Nitroglycerin | 30.0 | 30.0 | 28–32 |
| Ammonium Perchlorate* | 36.0 | 0.0 | |
| Porous Ammonium Perchlorate** | 0.0 | 36.0 | 34–38 |
| Aluminum Powder | 1.4 | 1.4 | 1–3 |
| Aluminum Staples | 5.8 | 5.8 | 4–8 |
| Triacetin | 6.7 | 6.7 | 4–8 |
| Resorcinol | 1.1 | 1.1 | 0.5–1.5 |
| 2-Nitrodiphenylamine | 1.0 | 1.0 | 0.5–1.5 |
| PROPELLANT CHARACTERISTICS | | | |
| Burning Rate (@2000 psi) | 3.60 | 7.8 | |
| Burning Rate Exponent | 0.56 | 0.5 | |
| Density (l bm/in$^3$) | 0.0621 | 0.0615 | |
| Delivered Specific Impulse (lbf-s/lbm) | 253 | 253 | |

*Ultra-Ultrafine ammonium perchlorate (0.6 micrometer, average weight diameter) Oxidizer blended with 90 micrometer ammonium perchlorate (12 parts ultra-ultrafine with 24 parts 90 micrometer)

**Prepared by Slow-Speed Mikropulverizer, ground and coated with about 5 weight percent of an N-arylalkeneimine Based on thermodynamic calculation, two basic propellant formulations A and B have been selected for evaluation purposes. These formulations A and B contained 36% oxidizer. Propellants A and B contained 36% ammonium perchlorate oxidizer, 1.4% aluminum powder, 5.8% aluminum flake, 18% nitrocellulose (12.6% N), 30% nitroglycerin, 6.7% triacetin, 1.1% of resorcinol stabilizer, and 1.0% 2-nitrodiphenylamine stabilizer. Additives, trace amounts can be used, to achieve desired processing conditions and properties of the finished propellant. Propellant B had all the ammonium perchlorate in the form of porous ammonium perchlorate; otherwise, compositions A and B are the same.

Table 1 contains a percentage breakout of the compositions of the two representative baseline high-burning propellant formulations which are presented to provide the comparative evaluation between porous ammonium perchlorate (Propellant B) and a mixture consisting of bimodal sizes of ammonium perchlorate (Propellant A).

Table I also shows data relating to Propellants A and B. A comparison of propellant properties, including burning rate exponent, burning rate, density, and delivered specific impulse are presented.

A review of ballistic properties of Propellant B as compared to Propellant A indicates over a twofold increase in the burning rate, a lower burning rate exponent, a lower density, and a specific impulse that is retained at the same high level as for the more dense propellant containing no porous ammonium perchlorate.

Porous ammonium perchlorate employed in this invention is prepared from unground or slow-speed ammonium perchlorate (180-micrometers) or from Micropulverized ammonium perchlorate (90 micrometers). The porosity in the crystal pattern is produced by heating the commercially available ammonium perchlorate at 265° C. for approximately 45 minutes, or until the material has undergone a weight loss of 20–25%. The resulting porous crystals of ammonium perchlorate are then coated with a thin layer of homopolymerizable monomer dissolved in an appropriate solvent which is a non-solvent for the ammonium perchlorate. Routine propellant processing procedures which are standard to the industry can be used in fabricating solid propellants containing porous ammonium perchlorate without abrading off the coating or crushing the porous ammonium perchlorate.

The polymeric coating for porous ammonium perchlorate (5% based on the weight of ammonium perchlorate) was found to be adequate to protect the porosity even under the rigorous conditions of propellant mixing. The polymeric coating is produced by the homopolymerization of an N-arylalkeneimine. The reaction is acid-catalyzed, and takes place rapidly when applied to the porous ammonium perchlorate. The coating process is carried out in a solvent, such as, hexane, in which the ammonium perchlorate is insoluble. After the homopolymerization has taken place, the solvent is removed completely under reduced pressure at low temperatures.

Retention of the porosity that has been produced in the porous ammonium perchlorate through the use of a surface coating is necessary because processing studies have demonstrated that any reduction in the void content results in a decrease in the effectiveness of porous ammonium perchlorate to produce the ultra-ultrahigh burning rates.

Porous ammonium perchlorate offers several advantages over the nonporous ultra-ultrafine ammonium perchlorate, and these make it particularly attractive for application in high burning rate propellant compositions. Some of these advantages are:

(1) The ultra-ultrafine ammonium perchlorate requires an inordinately large quantity of organic coating on the ammonium perchlorate particles to prevent their agglomeration. Since the organic coating is the propellant binder, a smaller amount of free binder is available as a working fluid for propellant mixing and processing. This makes propellant processing difficult.

(2) An appreciable amount of dispersant is necessary to prevent the ultra-ultrafine ammonium perchlorate from agglomerating. The dispersant needs to be subsequently removed, otherwise it would interfere with the satisfactory compounding of the propellant.

(3) A highly effective surfactant is necessary to lower the working viscosity of the propellant to workable levels. This is especially so as the particle size of the ammonium perchlorate is reduced more and more.

(4) A diluent mix process appears as if it is going to be necessary so that the ultra-ultrafine ammonium perchlorate can be incorporated into the propellant. This is unnecessary for the porous ammonium perchlorate.

I claim:

1. An ultra-ultrahigh burning rate composite modified double-base propellant composition consisting of an aluminum metal fuel in a combined weight percent from about 5 weight percent to about 11 weight percent, said aluminum metal fuel being present in an amount from about 1–3 weight percent of aluminum powder and in an amount from about 4–8 weight percent of aluminum staples; porous ammonium perchlorate in an amount from about 34–38 weight percent, said porous ammonium perchlorate coated with an N-arylalkeneimine to protect the porosity during propellant mixing; a nitrocellulose binder in an amount from about 16 to about 20 weight percent; nitroglycerin as an explosive plasticizer in an amount from about 28 to about 32 weight percent; triacetin as a non-explosive plasticizer in an amount from about 4 to about 8 weight percent; and an amount from about 1–3 weight percent of stabilizers selected from resorcinol and 2-nitrodiphenylamine.

2. The ultra-ultrahigh burning rate composite modified double-base propellant composition of claim 1 wherein said aluminum powder is present in an amount of about 1.4 weight percent and said aluminum staples are present in an amount of about 5.8 weight percent; said porous ammonium perchlorate is present in an amount of about 36 weight percent; said nitrocellulose binder is present in an amount of about 18 weight percent; said nitroglycerin is present in an amount of about 30 weight percent; said triacetin is present in an amount of about 6.7 weight percent; and said stabilizers selected are resorcinol that is present in an amount of about 1.1 weight percent and 2-nitrodiphenylamine that is present in an amount of about 1.0 weight percent.

* * * * *